US008364354B2

(12) United States Patent
Pline

(10) Patent No.: US 8,364,354 B2
(45) Date of Patent: Jan. 29, 2013

(54) BLADE SPEED CONTROL LOGIC

(75) Inventor: Jason Michael Pline, Dubuque, IA (US)

(73) Assignee: Deere & Company, Moline, IL (US)

( * ) Notice: Subject to any disclaimer, the term of this patent is extended or adjusted under 35 U.S.C. 154(b) by 1132 days.

(21) Appl. No.: 12/257,632

(22) Filed: Oct. 24, 2008

(65) Prior Publication Data

US 2010/0106381 A1 Apr. 29, 2010

(51) Int. Cl.
*G06F 7/70* (2006.01)

(52) U.S. Cl. ..... 701/50; 172/4.5

(58) Field of Classification Search ..... 701/50; 172/4.5

See application file for complete search history.

(56) References Cited

U.S. PATENT DOCUMENTS 4,166,506 A * 9/1979 Tezuka et al. ..... 172/4.5
4,888,890 A * 12/1989 Studebaker et al. ..... 37/348
4,934,463 A * 6/1990 Ishida et al. ..... 172/4.5
5,011,358 A * 4/1991 Andersen et al. ..... 414/273
5,065,326 A * 11/1991 Sahm ..... 701/50
5,224,033 A * 6/1993 Nakamura et al. ..... 700/65
5,499,684 A * 3/1996 Stratton ..... 172/4.5
6,105,679 A * 8/2000 Schubert et al. ..... 172/4
6,253,160 B1 6/2001 Hanseder
6,430,490 B1 * 8/2002 Watanabe et al. ..... 701/50
2006/0064216 A1 * 3/2006 Palmer ..... 701/41

OTHER PUBLICATIONS

John Deere ""J" Backhoes" 14-17 Ft. Digging Depth Catalog, Aug. 2003, 40 pgs.

* cited by examiner

*Primary Examiner* — Thomas B Will
*Assistant Examiner* — Joel F. Mitchell
(74) *Attorney, Agent, or Firm* — Faegre Baker Daniels LLP

(57) ABSTRACT

A construction vehicle is provided having a manual mode in which an operator provides manual inputs to control the movement of a blade to a location and an automatic mode in which a control moves the blade to a predetermined location. The speed of the movement of the blade in the automatic mode is scaled down from the speed of the blade in the manual mode.

22 Claims, 3 Drawing Sheets

BLADE SPEED CONTROL LOGIC

FIELD OF THE INVENTION

The present invention relates to construction vehicles and, more particularly, to a method of controlling the speed of a blade tip of a construction vehicle.

BACKGROUND AND SUMMARY OF THE INVENTION

Construction vehicle nay have a manual mode and an automatic mode. In the manual mode, the location of a blade tip may be controlled by user inputs. In an automatic mode, a controller moves the location of the blade tip to a predetermined location. If the controller moves the blade tip too fast, it may overrun the desired location or cause movement that is not smooth.

According to one aspect of the present invention, a construction vehicle is provided that moves materials. The construction vehicle includes a chassis; a plurality of traction devices operably coupled to the chassis to propel the chassis; a blade supported by the chassis and configured to interact with materials to be moved by the vehicle; and a hydraulic system. The hydraulic system includes a plurality of hydraulic cylinders positioned to move the blade between a plurality of positions; a source of pressurized fluid providing pressurized hydraulic fluid; a plurality of user inputs positioned to receive inputs from an operator of the construction vehicle; and a control system having a manual mode and an automatic mode, a controller, and memory storing a predetermined location of the blade. When in the manual mode, pressurized fluid from the source of pressurized fluid is available to a first hydraulic cylinder of the plurality of hydraulic cylinders at a first maximum pressure and the flow of fluid to the first hydraulic cylinder in controlled through operator input to a first input of the plurality of user inputs. When in the automatic mode, pressurized fluid from the source of pressurized fluid is available to the first hydraulic cylinder at a second maximum pressure that is less than the first maximum pressure and the flow of fluid to the first hydraulic cylinder is controlled by the controller using the predetermined location stored in the memory.

According to another aspect of the present invention, a construction vehicle is provided including a chassis; a plurality of traction devices operably coupled to the chassis to propel the chassis; a blade supported by the chassis and configured to interact with materials to be moved by the vehicle; and a hydraulic system. The hydraulic system includes a plurality of hydraulic cylinders positioned to move the blade between a plurality of positions; a source of pressurized fluid providing pressurized hydraulic fluid; a plurality of user inputs positioned to receive inputs from an operator of the construction vehicle; and a control system having a manual mode and an automatic mode, a controller, and memory storing a predetermined location of the blade. When in the automatic mode, the controller controls the flow of fluid to a first hydraulic cylinder of the plurality of hydraulic cylinders to position the blade in the predetermined location and the controller scales down a maximum available pressure from the source of pressurized fluid to the first hydraulic cylinder of the plurality of hydraulic cylinders when compared to a maximum available pressure when in the manual mode.

According to another aspect of the present invention, a method of moving material is provided. The method includes the steps of providing a construction vehicle including a chassis, a plurality of traction devices operably coupled to the chassis to propel the chassis, a blade supported by the chassis and configured to interact with materials to be moved by the vehicle, and a hydraulic system. The hydraulic system includes a plurality of hydraulic cylinders positioned to move the blade between a plurality of positions; a source of pressurized fluid providing pressurized hydraulic fluid; a plurality of user inputs positioned to receive inputs from an operator of the construction vehicle; and a control system having a manual mode and an automatic mode, a controller, and memory. The method further includes the steps of storing a predetermined location of the blade into the memory; moving the blade to a location in response to manual user input to a first input of the plurality of user inputs; switching the control system from the manual mode to the automatic mode; scaling down the supply of pressurized fluid available to a first hydraulic cylinder of the at least one of the plurality of hydraulic cylinders in response to switching step; moving the blade to the predetermined location after the switching step; switching the control system from the automatic mode to the manual mode; scaling up the supply of pressurized fluid available to the first hydraulic cylinder in response to the step of switching the control system from the automatic mode to the manual mode, and moving the blade to a location in response to manual user input to the first input after the step of switching the control system from the automatic mode to the manual mode.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1:
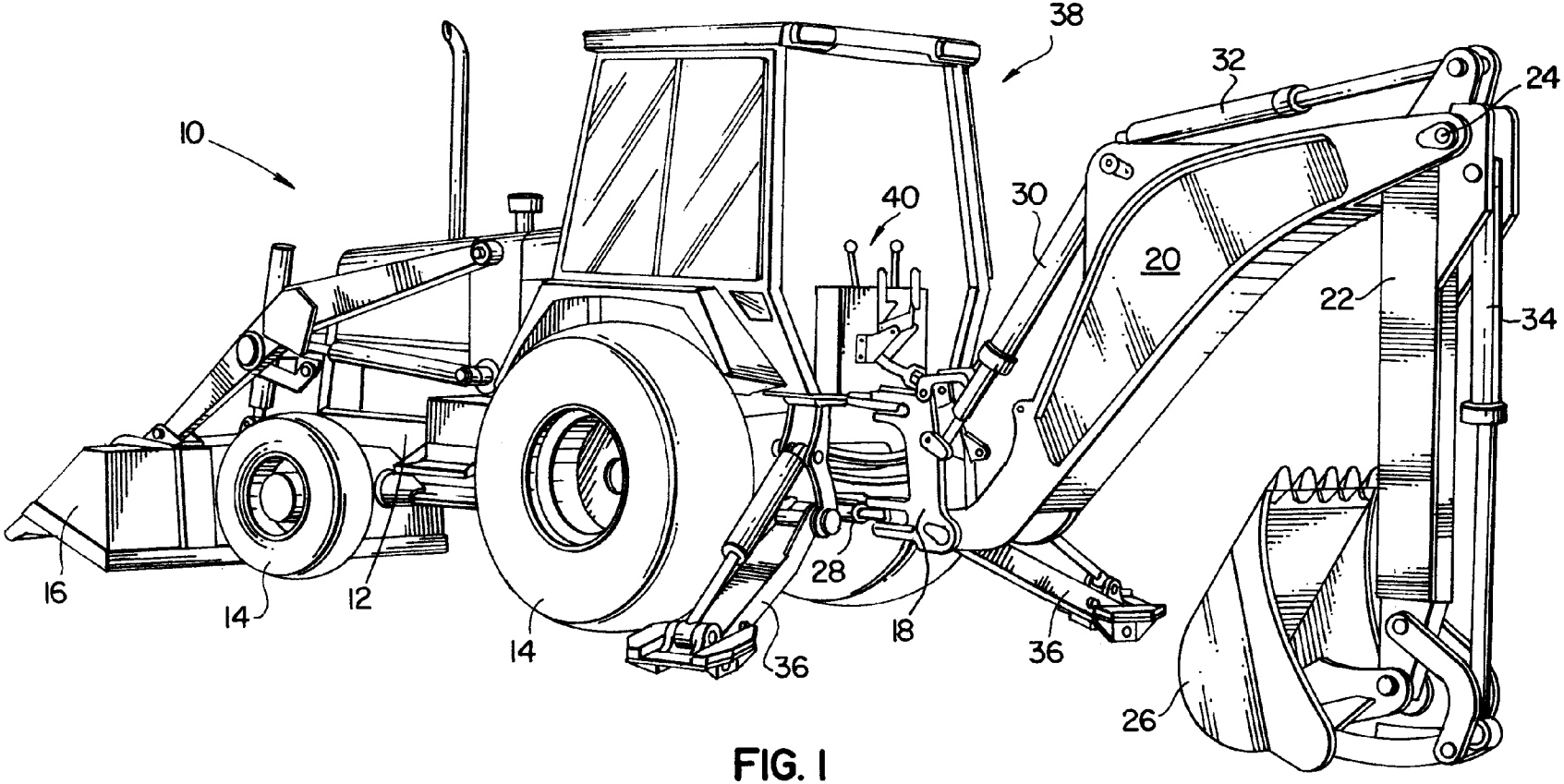
FIG. 1 is a perspective view of a piece of construction equipment or construction vehicle showing the vehicle including a chassis, a plurality of wheels, and a boom and bucket assembly configured to move material from one location to another.

FIG. 1 illustrates a construction vehicle, such as a backhoe loader 10, having a chassis/frame 12 to which are mounted ground engaging wheels 14 for supporting and propelling frame 12. Although the current disclosure is illustrated as a wheeled work vehicle, it can also be mounted on a crawler work vehicle having tracks or other suitable work vehicles having traction devices other than wheels for supporting and propelling a frame. In addition, the blade tip logic of the present disclosure could be used other construction vehicles, such as excavators, motor graders, crawlers, bull dozers, etc. Backhoe loader 10 is provided with a loader bucket 16 having a suitable loader bucket linkage for manipulating loader bucket 16 relative to frame 12. The rear of vehicle frame 12 is provided with a swing frame 18. A boom 20 is pivotally coupled to swing frame 18, a dipperstick 22 is pivotally connected to boom 20 at pivot 24, and a blade/bucket 26 is pivotally connected to dipperstick 22. Vehicle 10 includes several cylinders for manipulating the position and orientation of bucket 26 including one or more swing cylinders 28 that move boom 20 side-to-side relative to frame 12, one or more boom cylinders 30 that rotate boom 20 relative to frame 12; one or more crowd cylinders 32 that rotates dipperstick 22 relative to boom 20; and one or more bucket cylinders 34 that rotate bucket 26 relative to dipperstick. Backhoe loader 10 is also provided with two stabilizers 36.

Figure 2:
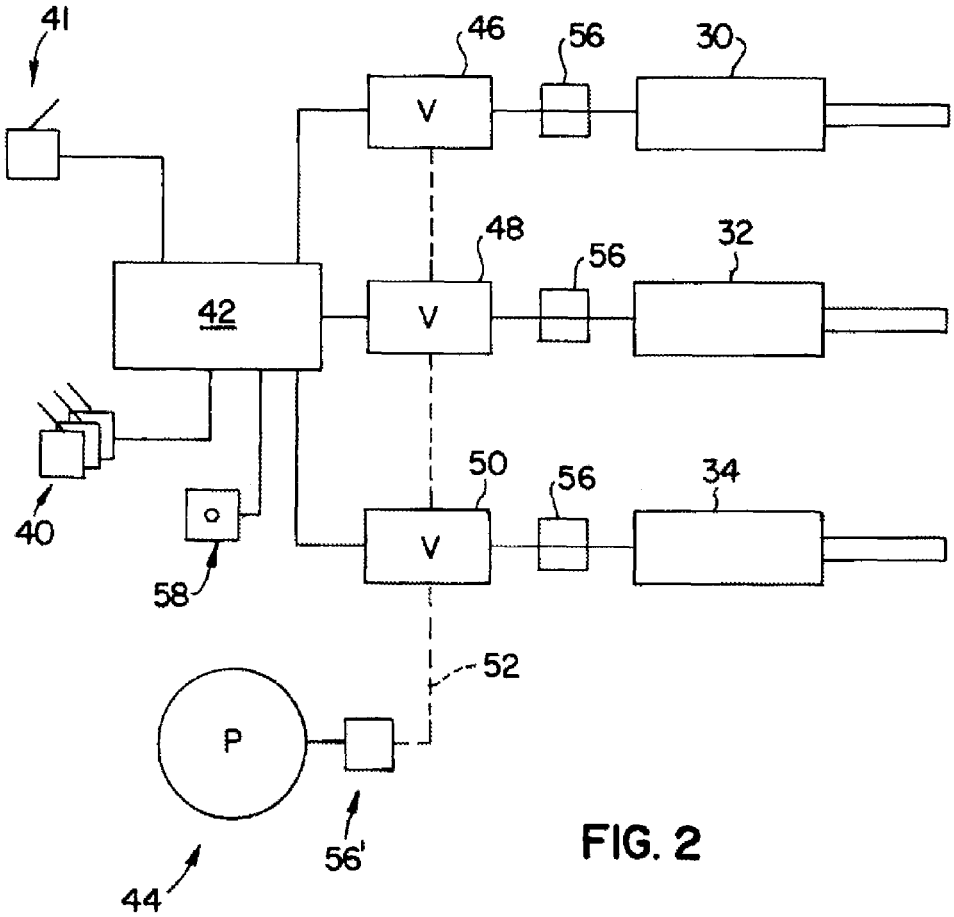
FIG. 2 is a schematic view of a control system for moving the boom and bucket.

The operation of vehicle 10 is controlled from either an open or closed operator's station 38. The operator may operator bucket 26 in manual mode or an automatic mode. In the manual mode, the operator manipulates a plurality of operator controls or levers 40 positioned in operator's station 38. In the automatic mode, the operator presses a mode button (or moves a switch) 41, as shown in FIG. 2, and a controller 42 automatically moves the tip of bucket 26 to a predetermined location and orientation. The predetermined location and orientation may be provided by a grade control system that attempts to match to the location and/or orientation of the tip of bucket 26 to a programmed position and/or orientation. Additional details of a suitable grade control system are provided in U.S. Pat. No. 6,253,160 to Hanseder, the entire disclosure of which is expressly incorporated by reference herein. Other grade control systems may also be used with the present disclosure including laser guided systems and sonic system.

As shown in FIG. 2, vehicle 10 includes a pump 44 that provides pressurized fluid, a boom valve 46 that controls the flow of hydraulic fluid from pump 44 to boom cylinder 30; a crowd valve 48 that controls the flow of hydraulic fluid from pump 44 to crowd cylinder 32, and a bucket valve 50 that controls the flow of hydraulic fluid from pump 44 to bucket cylinder 32. A hydraulic line 52 (shown in phantom) provides hydraulic fluid to valves 46, 48, 50.

The position of cylinders 30, 32, 34 controls the location of the tip of bucket 26. Controller 42 may provide hydraulic, electric, or other signals to valves 46, 48, 50 to provide control thereof. Similarly, controller 42 may receive hydraulic, electric, or other signals from levers 40 or the other control inputs.

Cylinders 30, 32, 34 may be dual acting cylinders that allow for extension and retraction. Although single hydraulic lines 54 are shown extending from valves 46, 48, 50 to cylinders 30, 32, 34, multiple lines may be provided to supply pressurized fluid to either side of pistons (not shown) within cylinders 30, 32, 34. Similarly, although not shown, a tank, accumulator, or other reservoir is provided to receive fluid flowing out of cylinders 30, 32, 34. Valves 46, 48, 50 are provided with multiple ports to receive fluid from pump 44, direct fluid from valve 46, 48, 50 to a reservoir, and direct pressurized fluid to valves 46, 48, 50 as necessary. Additional details of suitable valves 46, 48, 50 are provided in U.S. Pat. No. 7,415,822, titled "Load sense boost device," to Harber et al., filed Jul. 21, 2005, the entire disclosure of which is incorporated by reference herein.

In the manual mode, an operator provides manual inputs to levers 40. In response to inputs from levers 40, controller 42 controls the position of valves 46, 48, 50 to control the flow of fluid to and from cylinders 30, 32, 34. Thus, an operator manually moves levers 40 to position the tip of bucket 26 in the desired location to scoop up or otherwise move material, such as dirt.

In the automatic mode, controller 42 controls the position of valves 46, 48, 50 to control the flow of fluid to and from cylinders 30, 32, 34. Thus, an operator presses mode button 41 and controller 42 controls the movement of the tip of bucket 26 to a predetermined location stored in the memory of controller 42 or other memory of vehicle 10. Unlike the manual mode, less than full pressure and/or the full flow rate available from hydraulic pressure from pump 44 is used to move the tip of bucket 26. For example, if full available pump pressure from pump 44 to cylinders 30, 32, 34 under the manual mode is 2,500 psi, controller 42 provides less than 2,500 psi to one or more of cylinders 30, 32, 34 under the automatic mode. According to one embodiment, controller 42 scales back the available pressure by 5 or 10%. According to other embodiments, controller 42 scales back the available pressure by other percentages or amounts, such as 20%, 30%, 40%, 50%, 60%, 70%, 80%, or 90%. As a result of the scaling back (or down), the tip of bucket 26 moves at a slower rate. Thus, an operator can move the tip of bucket 26 faster during the manual mode than controller 42 can move the tip during the automatic mode. According to one embodiment, a user or programmer can adjust the amount of scaling using an input 58 or by adjusting the programming of controller 42. The adjustments may be discrete or infinite.

As shown in FIG. 2, controller 42 reduces the available pressure or flow to cylinders 30, 32, 34 using flow restrictors 56 to reduce the pressure and flow. Flow restrictors 56 are electrically or hydraulically controlled, for example. During the manual mode, flow restrictors 56 provide little, if any, pressure drop and/or flow restriction. During the automatic mode, flow restrictors 56 drop the pressure and/or restrict the flow of fluid. Although restrictors 56 are shown separate from valves 46, 48, 50, restrictors 56 may be incorporated as part thereof. According to another embodiment, a single restrictor 56' is provided downstream of pump 44 to reduce the pressure from pump 44. Further, controller 42 may provide the functional equivalents of restrictors 56 by reducing the available pressure output from pump 44. For example, during manual operation, controller 42 may control pump 44 to provide a maximum pressure output of 2,500 psi and during automatic operation, controller 42 may control pump 44 to provide a maximum pressure output of 2,250 psi (i.e. 10% less than the maximum pressure output).

As a result of providing less pressure to cylinders 30, 32, 34, they move in a slower, smother manner than if full pressure (ex. 2,500 psi) is provided. For example, at full pressure, cylinders 30, 32, 34 may over shoot their desired position. This overshooting is reduced by providing less pressure to cylinders 30, 32, 34. According to one embodiment, full pressure is provided to one or more of cylinders 30, 32, 34 during the manual mode, and less than full pressure is provided to the other cylinders 30, 32, 34 during the automatic mode.

Although vehicle 10 is shown as a backhoe loader, the principles of the present disclosure may also be applied to other construction vehicles. For example, according to one embodiment of the present disclosure, the principles are applied to the tilt and lift of a mold board/grader blade of a motor grader.

Figure 3:
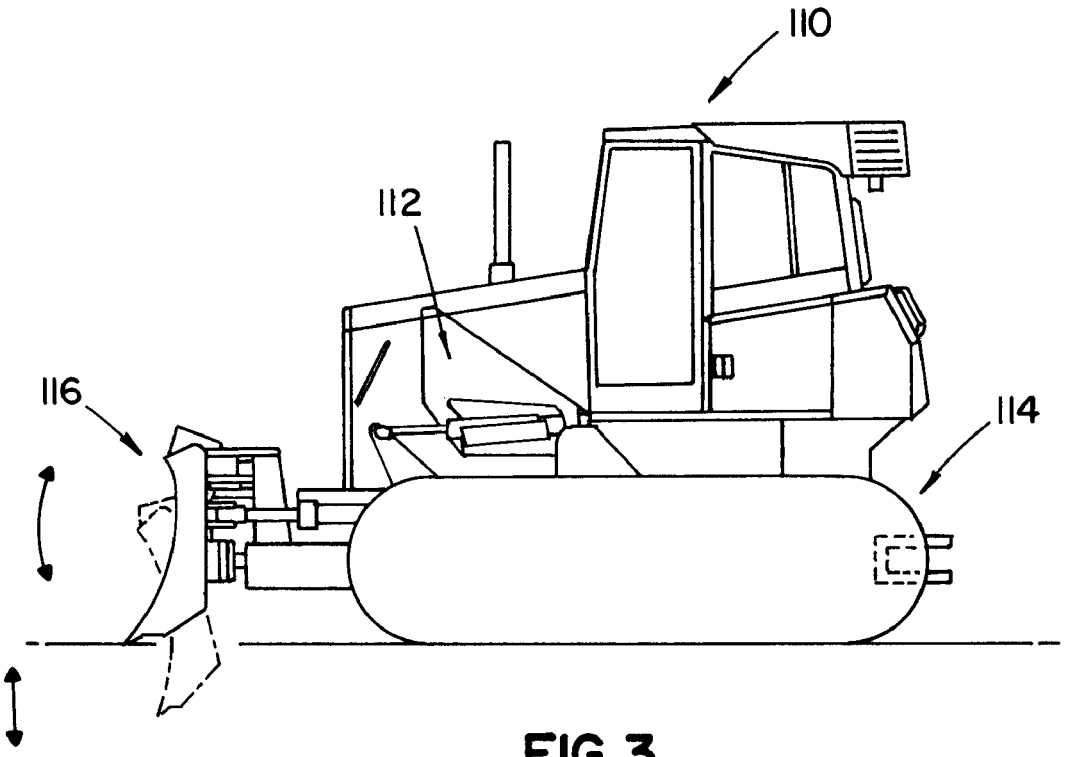
FIG. 3 is a side elevation view of a crawler dozer showing the dozer including a chassis, a track, and a dozer blade configured to move material from one location to another.
Figure 4:
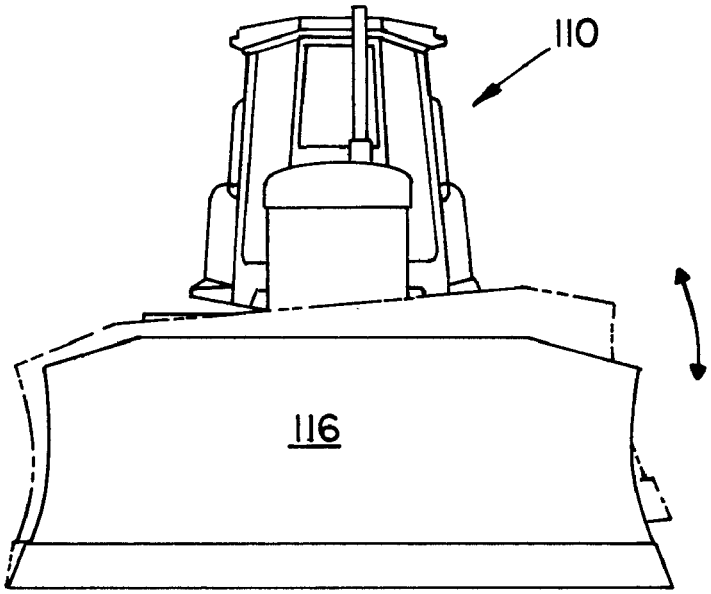
FIG. 4 is a front view of the crawler dozer of FIG. 3.

Another example is shown in FIGS. 3 and 4 showing a crawler dozer 110 having a chassis/frame 112 to which are mounted ground engaging tracks 114 for supporting and propelling frame 112. Crawler dozer 110 is provided with a dozer blade 116 that can be raised and lowered (as shown in FIG. 3), titled between multiple positions (as shown in FIG. 4), and angled between multiple positions (as shown in FIG. 3). Cylinders such as hydraulic cylinders 30, 32, 34 may be used to perform these raise, tilt, and angle adjustments. When in the automatic mode, such as when a grade control system is activated, controller 42 moves a lower tip of dozer blade 116 to a desired height and tilt to obtain a predetermined height and grade of earth as crawler dozer 110 grades a work site. According to one embodiment, the supply of pressurized fluid to tilt cylinder 32 is scaled down during movement of dozer blade 116 to this predetermined location and orientation. While the supply of pressure to tilt cylinder 32 is scaled down during this automatic mode, the supply of fluid to height cylinder 30 may remain at full pressure. Thus, the adjustment of the tilt of blade 116 is slowed down and the adjustment of the height of blade 116 is not. The supply of fluid to angle cylinder 34 may remain at full pressure and under manual control while tilt and height cylinders 32, 30 are under the control of the automatic mode.

Although the invention has been described in detail with reference to certain preferred embodiments, variations and modifications exist within the spirit and scope of the invention as described and defined in the following claims.

The invention claimed is:

1. A construction vehicle configured to move materials, the construction vehicle including:

a chassis;

a plurality of traction devices operably coupled to the chassis to propel the chassis;

a blade supported by the chassis and configured to interact with materials to be moved by the vehicle; and a hydraulic system including a plurality of hydraulic cylinders positioned to move the blade between a plurality of positions;

a source of pressurized fluid providing pressurized hydraulic fluid;

a plurality of user inputs positioned to receive inputs from an operator of the construction vehicle; and a control system having a manual mode and an automatic mode, a controller, and memory storing a predetermined location of the blade, when in the manual mode, pressurized fluid from the source of pressurized fluid is available to a first hydraulic cylinder of the plurality of hydraulic cylinders at a first maximum pressure and the flow of fluid to the first hydraulic cylinder in controlled through operator input to a first input of the plurality of user inputs, when in the automatic mode, pressurized fluid from the source of pressurized fluid is available to the first hydraulic cylinder at a second maximum pressure that is less than the first maximum pressure and the flow of fluid to the first hydraulic cylinder is controlled by the controller using the predetermined location stored in the memory.

2. The construction vehicle of claim 1, wherein the second maximum pressure is at least 5 percent less than the first maximum pressure.

3. The construction vehicle of claim 1, wherein the second maximum pressure and the first maximum pressure cooperate to define a ratio and the plurality of user inputs includes a scaling input that allows adjustment of the ratio.

4. The construction vehicle of claim 1, wherein pressurized fluid from the source of pressurized fluid is available to a second hydraulic cylinder of the plurality of hydraulic cylinders at the first maximum pressure when the control system is in the automatic mode.

5. The construction vehicle of claim 1, wherein pressurized fluid from the source of pressurized fluid is available to a second hydraulic cylinder of the plurality of hydraulic cylinders at the second maximum pressure when the control system is in the automatic mode.

6. The construction vehicle of claim 1, wherein a maximum speed of the blade is greatest when the control system is in the manual mode.

7. The construction vehicle of claim 1, wherein the hydraulic system further includes a plurality of flow control valves, each of the plurality of flow control valves positioned in fluid communication with the source of pressurized fluid and a corresponding one of the plurality of hydraulic cylinders to direct pressurized hydraulic fluid from the source of pressurized fluid to the corresponding one of the plurality of hydraulic cylinders when in both the manual mode and the automatic mode.

8. A construction vehicle configured to move materials, the construction vehicle including:

a chassis;

a plurality of traction devices operably coupled to the chassis to propel the chassis;

a blade supported by the chassis and configured to interact with materials to be moved by the vehicle; and a hydraulic system including a plurality of hydraulic cylinders positioned to move the blade between a plurality of positions;

a source of pressurized fluid providing pressurized hydraulic fluid;

a plurality of user inputs positioned to receive inputs from an operator of the construction vehicle; and a control system having a manual mode and an automatic mode, a controller, and memory storing a predetermined location of the blade, when in the automatic mode, the controller controls the flow of fluid to a first hydraulic cylinder of the plurality of hydraulic cylinders to position the blade in the predetermined location and the controller scales down a maximum available pressure from the source of pressurized fluid to the first hydraulic cylinder of the plurality of hydraulic cylinders when compared to a maximum available pressure when in the manual mode.

9. The construction vehicle of claim 8, wherein the maximum available pressure when in the automatic mode is at least 5 percent less than the maximum available pressure when in the manual mode.

10. The construction vehicle of claim 8, wherein the maximum available pressure when in the automatic mode and the first maximum available pressure when in the manual mode cooperate to define a ratio and the plurality of user inputs includes a scaling input that allows adjustment of the ratio.

11. The construction vehicle of claim 8, wherein, when the control system is in the automatic mode to operate the first hydraulic cylinder automatically, pressurized fluid from the source of pressurized fluid is available to a second hydraulic cylinder of the plurality of hydraulic cylinders at the maximum pressure that would have been available to the first hydraulic cylinder when in the manual mode, such that the first and second hydraulic cylinders differ in maximum available pressure.

12. The construction vehicle of claim 8, wherein, when the control system is in the automatic mode to operate the first hydraulic cylinder automatically, pressurized fluid from the source of pressurized fluid is available to a second hydraulic cylinder of the plurality of hydraulic cylinders at the same maximum pressure available to the first hydraulic cylinder when in the automatic mode.

13. The construction vehicle of claim 8, wherein a maximum speed of the blade is greatest when the control system is in the manual mode.

14. The construction vehicle of claim 8, wherein the pressurized hydraulic fluid travels along the same path from the source of pressurized fluid to the first hydraulic cylinder in the manual mode as in the automatic mode.

15. A method of moving material is provided, the method includes the steps of providing a construction vehicle including a chassis, a plurality of traction devices operably coupled to the chassis to propel the chassis, a blade supported by the chassis and configured to interact with materials to be moved by the vehicle, and a hydraulic system including a plurality of hydraulic cylinders positioned to move the blade between a plurality of positions;

a source of pressurized fluid providing pressurized hydraulic fluid;

a plurality of user inputs positioned to receive inputs from an operator of the construction vehicle; and a control system having a manual mode and an automatic mode, a controller, and memory, storing a predetermined location of the blade into the memory;

moving the blade to a location in response to manual user input to a first input of the plurality of user inputs, switching the control system from the manual mode to the automatic mode, scaling down the supply of pressurized fluid available to a first hydraulic cylinder of the at least one of the plurality of hydraulic cylinders in response to switching step, moving the blade to the predetermined location after the switching step, switching the control system from the automatic mode to the manual mode, scaling up the supply of pressurized fluid available to the first hydraulic cylinder in response to the step of switching the control system from the automatic mode to the manual mode, and moving the blade to a location in response to manual user input to the first input after the step of switching the control system from the automatic mode to the manual mode.

16. The method of claim 15, wherein the scaling down step reduces the maximum available flow of pressurized fluid to the first hydraulic cylinder by at least 5 percent.

17. The method of claim 15, wherein the scaling down step reduced the maximum available pressure of pressurized fluid to the first hydraulic cylinder by at least 5 percent.

18. The method of claim 15, further including the step adjusting the magnitude of scaling that occurs during the scaling down step.

19. The method of claim 15, wherein the first input has only on and off positions and the supply of pressurized fluid provided to the first hydraulic cylinder when the first input is in the on position and the control system is in the manual mode is greater than the supply of pressurized fluid provided to the first hydraulic cylinder when the control system is in the automatic mode.

20. The method of claim 15, wherein the step of switching the control system from the automatic mode to the manual mode occurs automatically after the step of moving the blade to the predetermined location is complete.

21. The method of claim 15, wherein the step of switching the control system from the manual mode to the automatic mode occurs after a manual input from a user.

22. The method of claim 15, wherein the control system does not scale down pressurized fluid to at least one of the plurality of hydraulic cylinders during the scaling down step.

* * * * *